United States Patent [19]

Tucker

[11] 4,413,928

[45] Nov. 8, 1983

[54] REINFORCING AND CONFINING EARTH FORMATION

[76] Inventor: Michael C. Tucker, Halliburton Services, Athens Tower B, Suite 506, 610 Athens, Greece

[21] Appl. No.: 207,554

[22] Filed: Nov. 17, 1980

[30] Foreign Application Priority Data

Nov. 23, 1979 [ZA] South Africa ..... 79/6363

[51] Int. Cl.[3] ..... E21D 20/02

[52] U.S. Cl. ..... 405/260; 52/155; 405/258; 405/288

[58] Field of Search ..... 405/15, 16, 19, 32, 405/258, 260, 132, 288, 259; 24/261; 52/155; 411/457

[56] References Cited

U.S. PATENT DOCUMENTS

| | | | |
|---|---|---|---|
| 360,225 | 3/1887 | Kanters | 405/19 |
| 589,856 | 9/1897 | Rabitz | 405/16 |
| 1,358,042 | 11/1920 | Warmoth | 405/19 X |
| 1,559,560 | 11/1925 | Doughty | 405/260 |
| 2,143,461 | 1/1939 | Waring | 405/19 X |
| 2,318,349 | 5/1943 | Wiley | 405/15 |
| 3,412,561 | 11/1968 | Reid | 405/15 |

FOREIGN PATENT DOCUMENTS

| | | | |
|---|---|---|---|
| 2131647 | 12/1971 | Fed. Rep. of Germany | 405/16 |
| 45-28869 | 9/1970 | Japan | 405/258 |

*Primary Examiner*—David H. Corbin

*Attorney, Agent, or Firm*—Ladas & Parry

[57] ABSTRACT

Reinforcing and confining an earth formation is effected by restraining units having retaining limbs for insertion into prepared holes in the formation and transverse portions for lying against the formation. The retaining limbs are inserted into the prepared holes and the transverse portions of the units are thus arranged to define a mesh-like arrangement anchored at least partially by the retaining limbs. The end regions of the transverse portions are anchored to and linked together to hold the transverse portions against the earth formation. The units normally have at least two retaining limbs and these limbs are forced into the holes to a depth of between about 0.5 and 2 meters. Formations may be provided in the limbs to inhibit removal of the limbs.

17 Claims, 10 Drawing Figures

REINFORCING AND CONFINING EARTH FORMATION

This invention relates to a method of reinforcing and confining an earth formation, to units for use in such a method, and to suitable reinforcing and confining systems.

Support systems may be classified into two distinct forms, namely active support and passive support systems. Active support systems may be described as those systems which after installation immediately exert and maintain restraint against rock failure. Such systems are typified by traditional steel rockbolt systems. The support potential is directly related to the efficient utilisation of the tensile strength of the steel members used. Passive support systems may be described as those systems which become effective only after rock failure has occurred. The resultant rock closure is then resisted by the passive support. Passive support systems are typified by steel or timber props and packs. Their support potential is related to their compressive strength. However, due to the buckling mode of failure, the full compressive strength is seldom utilised.

The applicant has therefore aimed to provide a system using a rockbolting technique which would incorporate active and passive support to provide initial stiffness followed by yieldability.

The present invention thus provides a method of reinforcing and confining an earth formation by means of a plurality of restraining units, the units having retaining limbs for insertion into prepared holes in the formation and transverse portions for lying substantially against the formation, wherein the retaining limbs are inserted into the prepared holes and the transverse portions of the units are arranged to define a mesh-like arrangement anchored at least partially by the retaining limbs.

In this method, the end regions of the transverse portions may be anchored to hold the transverse portions substantially against the earth formation. For example, at least some of the units can have at least two retaining limbs and these limbs are then forced into the holes to anchor the units. The retaining limbs may normally be forced into the holes to a depth of between about 0.5 and 2 meters.

In order to improve the anchoring of the transverse portions, the method may include linking at least some of the units to other units. For example, the retaining limbs of at least some of the units can be linked by locating elements when the retaining limbs are inserted into the respective holes. These elements may be integral with or separate from the units. The anchorage in this case is provided by the shape of the units, the locating elements, and multiple anchorage in the holes. The units then cross the face of the formation in various directions and they are linked together and can be anchored deep into the formation. The mesh arrangement will oppose the deformation of the rock face and will transmit point loads across a large surface area.

In practice, the prepared holes in the earth formation can be formed in an array with the spacings between the holes being substantially equal to the lengths of the transverse portions of selected units, and a plurality of retaining limbs can be inserted into the majority of said holes. The spacings between the holes can be in the range of 0.5 to 1 meter. Owing to its nature, the mesh arrangement will lie close to the contour of the earth formation. By using a standard drilling pattern with a constant spacing, it is possible to alter the mesh openings to cater for a large range of formations. This is done by simply placing larger or smaller numbers of units in each hole and by interlinking the units in different holes. The mesh density can be further altered by changing the spacing of the drilling grid.

The retaining limbs may include means, such as kinks, for inhibiting the removal of the limbs from the holes, and the inhibiting means are then forced into the holes, for example by hammer blows, when the retaining limbs are inserted into the holes. Alternatively, or additionally, the retaining limbs can be grouted into the holes.

The invention also provides a system reinforcing and confining an earth formation, the system comprising a plurality of restraining units each having at least one retaining limb inserted into a respective hole in the earth formation and at least one transverse portion lying substantially against the formation, at least a substantial number of the holes receiving limbs of more than one unit and the transverse portions defining a mesh-like arrangement anchored at least partly by the reinforcing limbs.

At least some of the units can comprise a U-shaped configuration providing a pair of spaced retaining limbs and a transverse portion connecting the limbs, the transverse portions lying adjacent to the earth formation.

Means may be provided for inhibiting removal of the limbs from the holes, if needed. The inhibiting means may comprise locking formations provided by the retaining limbs of the units for anchoring the limbs in the holes, and additionally or optionally may comprise grouting material anchoring the retaining limbs in the holes. The concept of using each hole for multiple anchorage provides unique system characteristics. The system becomes extremely flexible since the number of limbs inserted into each hole can be varied according to requirements. Consequently, the tensile and shear strengths can be easily varied and a greater surface area can be provided for the bonding of the grout.

In one embodiment, the lengths of the retaining limbs are between 0.5 and 2 meter, and the lengths of the transverse portions are in the range of 0.5 to 1 meter.

A restraining unit suitable for an earth reinforcing and confining system may have a U-shaped configuration providing a pair of spaced retaining limbs for insertion into suitable spaced holes in an earth formation and a transverse portion connecting the limbs, the limbs having lengths of between 0.5 and 2 meters and including means for inhibiting removal of the limbs from suitably prepared holes, and the space in between the limbs being in the range of 0.5 and 1 meter.

Embodiments of the invention will now be described, by way of example, with reference to the accompanying drawings, in which FIG. 1 shows a restraining unit for a reinforcing and confining system;

Figure 1:
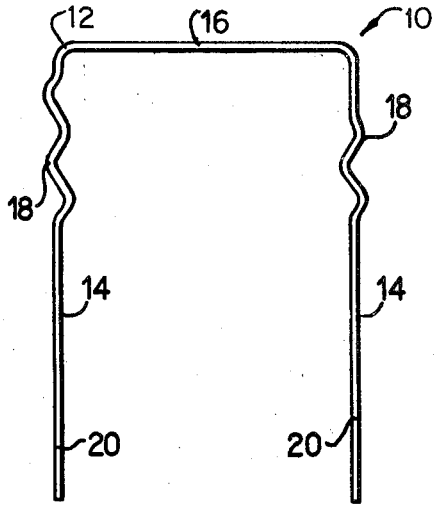

Referring firstly to FIG. 1, a restraining unit 10 for a rock reinforcing and confining system comprises an element 12 of round iron bar. This bar has been bent so that it has a generally U-shaped configuration providing a pair of spaced retaining limbs 14 which are united by a transverse central portion 16 of the unit.

The limbs 14 extend away from opposite ends of the central portion 16 and the central portion is substantially perpendicular to the directions in which the limbs extend. As shown in FIG. 1, each limb is bent to form substantially sinusoidal locking kinks 18 at portions closer to the central portion 16 than to the free ends of the limbs. The limbs also have relatively straight portions 20 extending away from the locking kinks.

The element 12 may suitably have a diameter of, for example, 9 mm and the limbs may be about 1 meter long. The central portion 16 may also be about 1 meter long, or possibly slightly less than this. Naturally, the lengths of the limbs and of the central portion will be varied depending on the selected drill hole density and required drill hole depth.

In practice, rock units suitable for use with drill hole depths of 1 meter, 1.5 meter and 2 meters and drill hole spacings of 1 meter, 0.75 meters and 0.5 meters would probably suit most requirements.

Figure 2:
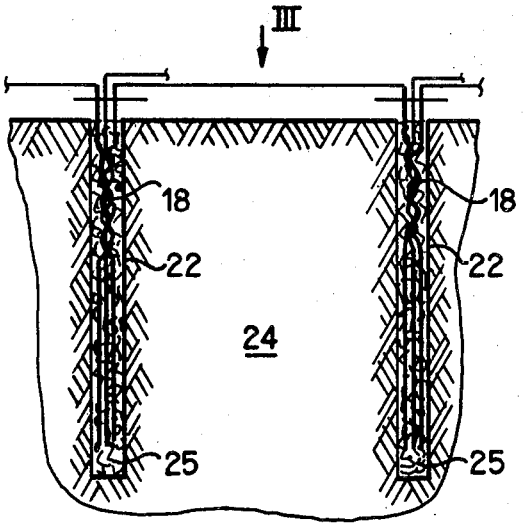
FIG. 2 is a cross-section through an earth formation illustrating part of a rock reinforcing and confining system.
Figure 3:
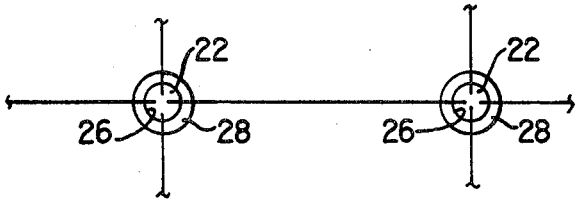
FIG. 3 shows an arrangement of part of the system of FIG. 2 in the direction of arrow III in FIG. 2.
Figure 6:
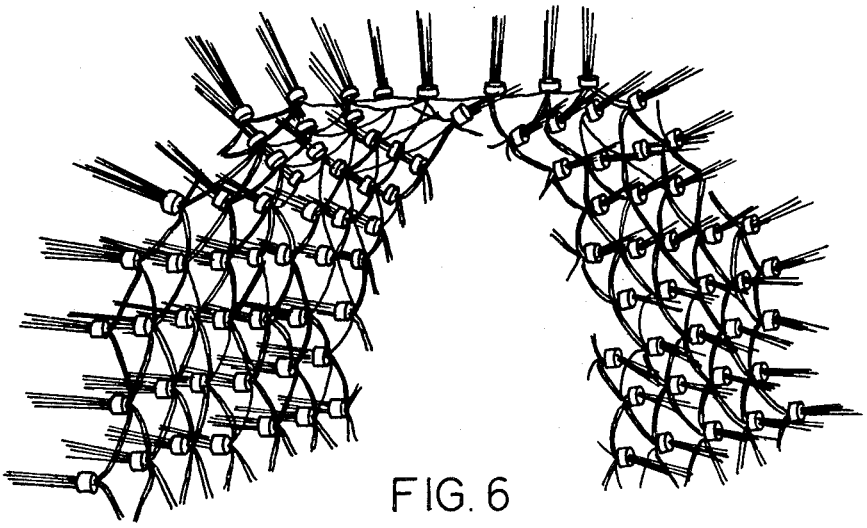
FIG. 6 is a schematic representation of part of reinforcing and confining system.

The unit of FIG. 1 may be used in the reinforcing and confining system of FIG. 6, part of which is shown in detail in FIGS. 2 and 3, by drilling holes 22 into a rock formation 24 with the central axes of the holes being the same distance apart as the limbs 14 of the units 10 to be used. The diameters of the holes should be selected to allow for an appropriate number of limbs to be anchored in each hole. The depths of the holes may be selected to allow for the limbs to be anchored to substantially their full depth.

Once the holes have been drilled into the rock formation, the limbs of the units are inserted into the holes and are pushed into the holes until the locking kinks 18 reach the mouths of the holes. The limbs are then driven into the holes with a suitable hammer and the kinks will serve to anchor the limbs in place. The kinks are shown out of proportion to the hole diameter in the Figures. Where rapid installation and a minimum support life is required, the units may be driven into position without any grout, relying solely on the action of the locking kinks to retain them in position. However, the units will normally be grouted into position by grouting material 25 to protect them from deterioration.

The limbs 14 of the various units passing into each hole may be passed through a central hole 26 in a locating element in the form of a locking washer 28 before being inserted into the hole. The locking washer adjacent to each hole may then ensure that any direct loading on a particular unit will be transmitted to the adjacent units.

Once the limbs 14 of the units have been properly located in the holes 22, the central portions 16 of the units will effectively form a mesh formation close to the contour of the face of the rock formation. By using a standard drilling pattern with a constant spacing, it is possible to alter the mesh openings to cater for a large range of rock formation sizes. This is done by simply locating larger or smaller numbers of units in each hole and by interlinking different holes. The mesh density can be further altered by changing the spacing of the drill holes.

Figure 4:
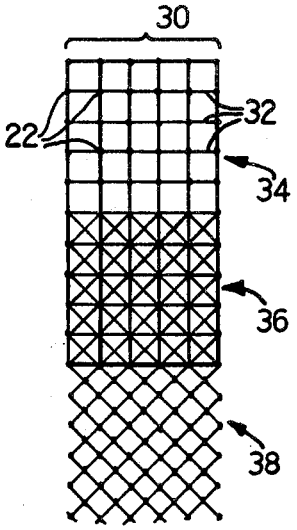
FIG. 4 shows three different system patterns.

FIG. 4 shows three basic patterns of units based on a square-grid system of drill holes 22. The drill holes are arranged in longitudinal rows 30 which are spaced one meter apart and transverse rows 32 which are also spaced one meter apart. In the zone 34, units are driven into the holes 22 with their central portions 16 extending only in the directions of the rows 30 and 32. A square mesh pattern is thus formed.

In the zone 36, the mesh pattern shown in the zone 34 is continued but a diagonal pattern of additional units is superimposed on the square pattern to form a relatively dense mesh pattern.

Finally, in zone 38, the square mesh pattern is no longer continued but the diagonal mesh arrangement is retained, forming a diamond mesh pattern. This is the form shown in FIG. 6.

FIG. 4 thus illustrates that it is possible for the units to cross the rock formation in different directions while being linked together at points which are anchored deep into the rock formation. The resulting mesh formation will oppose the deformation of the rock formation and will transmit point loads across a large area.

Figure 5:
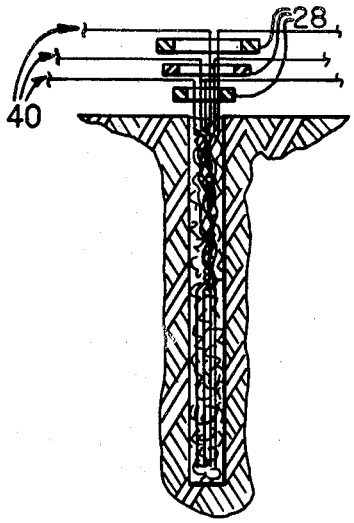
FIG. 5 is a cross-section through a rock formation showing part of another system.

With reference to FIG. 5, the U-shaped units may be arranged to provide two or more mesh layers 40. In this case, an increased number of locating elements, in this case also locking washers 28, is preferably used, the washer 28 closest to the hole surrounding the limbs of the units forming all of the layers, a second locking washer surrounding the limbs of the units forming the outer two layers and the third locking washer surrounding only the limbs of the units of the outer mesh layer. The layers may have limbs of differing lengths anchored in a common drill hole grid or in an alternative drill hole grid. This arrangement is particulary suitable for inhibiting the damaging effects of violent rock bursts because each consecutive layer of mesh takes load at different time intervals, preventing the instantaneous release of strain energy at the rock face.

In the past, rock support systems have mainly been active support systems, such as traditional rock bolt systems, which immediately exert and maintain restraint against rock failure action after installation or passive support systems, such as steel or timber props and packs which become effective only after rock failure has occurred. The system of the invention can form a composite reinforcing and confining structure such as that shown in FIG. 6 (the rock formation being omitted), and thus provides a support lining for a rock formation and in situ rock reinforcement. The system has active and passive support ability, providing increased stiffness of the reinforced rock formation and yieldability if the rock formation begins to move.

The system may be used with suitable linings for sealing rock faces and helping to maintain the integrity of rock faces. While the system can be used in combination with wire mesh, shotcrete or gunnite (that is cementitious material projected forcibly against the rock face), or sprayed plastics linings, the system can enhance the yieldability and strength of all these linings allowing them to absorb strain energy release while still supporting a rock formation, wire mesh and shortcrete being most suitable.

Although the units have been described in connection with supporting rock formations, it is possible that they could also be used elsewhere. For example, they could be used as reinforcing members for concrete work, for supporting the perimeter of yieldable concrete packs or in steel rope lacing for improving stope hanging wall support.

The material and shape of the unit will be selected to suit the particular application. Possible alternative shapes are shown in FIGS. 7 to 10.

Figure 7:
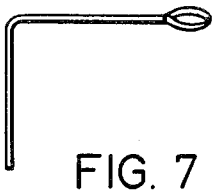
FIGS. 7 to 10 show reinforcing and confining units.

The unit of FIG. 7 is a simple L-shaped unit formed of similar material to the unit of FIG. 1 but having a loop at the free end of its transverse portion. The limbs of other units can pass through this loop when they are driven into holes in a rock formation, thus anchoring the free end of the transverse portion.

Figure 8:
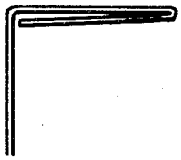
Figure 9:
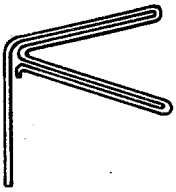
Figure 10:
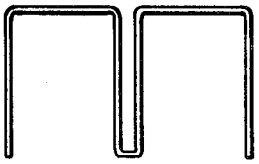

The units of FIGS. 8 and 9 are bent to form one and two doubled-back transverse portions, respectively. This arrangement thus provides U-shaped formations which serve the same purpose as the loop of FIG. 7. The unit of FIG. 10 simply has a double U-shaped configuration and can be used in a similar manner to two units of FIG. 1.

I claim:

1. A method of reinforcing and confining an earth formation by means of a plurality of restraining units, the units having retaining limbs for insertion into prepared holes in the formation and transverse portions for lying substantially against the formation, and means associated with said retaining limbs for inhibiting removal thereof from the holes, which method comprises forming an array of said holes in the formation with the spacing between said holes being substantially equal to the lengths of said transverse portions, inserting the retaining limbs into said holes with a plurality of said limbs in a majority of said holes, disposing the transverse portions of the units in contact with the surface of the formation, each of the transverse portions extending to different other holes to form a mesh-like arrangement anchored at least partially by the retaining limbs.

2. A method according to claim 1, wherein at least some of the units have at least two retaining limbs and these limbs are forced into the holes to anchor the units.

3. A method according to claim 2, wherein the retaining limbs are forced into the holes to a depth of between about 0.5 and 2 meters.

4. A method according to claim 1, which includes linking at least some of the units to other units.

5. A method according to claim 4, wherein the retaining limbs of at least some of the units are linked by locating elements when the retaining limbs are inserted into the respective holes.

6. A method according to claim 1, wherein the spacings between the holes is in the range of 0.5 to 1 meter.

7. A method according to claim 1, wherein the inhibiting means are forced into the holes when the retaining limbs are inserted into the holes.

8. A method according to claim 7, wherein the retaining limbs are grouted into the holes.

9. A system reinforcing and confining an earth-formation, the system comprising a plurality of restraining units, each unit having at least one retaining limb inserted into a pre-formed hole in the earth formation and at least one transverse portion in contact with the surface of the formation, a majority of the holes receiving limbs of more than one unit, the holes being formed in an array with the spacing between said holes being substantially equal to the lengths of said transverse portions and the transverse portions of said units extending to different other holes to form a mesh-like arrangement anchored at least partly by said retaining limbs, and means associated with said retaining limbs for inhibiting removal thereof from the holes.

10. A system according to claim 9, wherein at least some of the units comprise a U-shaped configuration providing a pair of spaced retaining limbs and a transverse portion connecting the limbs.

11. A system according to claim 9, wherein the inhibiting means comprises locking formations provided by the retaining limbs of the units for anchoring the limbs in the holes.

12. A system according to claim 11, wherein the inhibiting means further comprises grouting material anchoring the retaining limbs in the holes.

13. A system according to claim 11, including means linking together limbs received in respective holes.

14. A system according to claim 13, wherein the lengths of the retaining limbs are between 0.5 and 2 meter.

15. A system according to claim 14, wherein the lengths of the transverse portions are in the range of 0.5 to 1 meter.

16. A system according to claim 9, in which the inhibiting means are formations provided by the limbs.

17. An earth reinforcing and confining formation for an earth formation, comprising a plurality of restraining units each having a U-shaped configuration providing a pair of spaced retaining limbs in an array of pre-formed holes in a wall surface of said formation and a transverse portion substantially as long as the spacing between said holes connecting the limbs and in contact with the surface of the formation, a substantial number of said holes receiving limbs of more than one unit, the transverse portions of said units extending to different other holes to form a mesh-like arrangement anchored at least partly by said retaining limbs, the limbs having lengths of between 0.5 and 2 meters and including formations in said limbs for inhibiting removal of the limbs from said holes, and the space in between the limbs being in the range of 0.5 to 1 meter; means linking together limbs received in respective holes and grouting material further anchoring said limbs in said holes.

* * * * *